United States Patent [19]

Sloff et al.

[11] Patent Number: 5,006,682

[45] Date of Patent: Apr. 9, 1991

[54] LINEAR SNAP ACTION OPERATING MECHANISM AND AN ELECTRICAL SWITCH INCORPORATING SAME

[75] Inventors: Michael E. Sloff, Winston Salem; Neal E. Rowe, Asheville, both of N.C.

[73] Assignee: Westinghouse Electric Corp., Pittsburgh, Pa.

[21] Appl. No.: 356,091

[22] Filed: May 24, 1989

[51] Int. Cl.[5] ..... H01H 15/18

[52] U.S. Cl. ..... 200/429

[58] Field of Search ..... 200/425, 429, 428, 424, 200/400

[56] References Cited

U.S. PATENT DOCUMENTS

| | | | |
|---|---|---|---|
| 601,276 | 3/1898 | Platt | 200/429 |
| 1,362,661 | 12/1920 | Zimmerman | 200/429 |
| 3,053,950 | 9/1962 | Dobes | 200/429 |
| 3,264,431 | 11/1962 | Hodgson | 337/7 |
| 3,522,397 | 7/1970 | Dodson et al. | 200/429 |
| 4,086,452 | 4/1978 | Collins | 200/50 AA |
| 4,800,242 | 1/1989 | Yin | 200/400 |

*Primary Examiner*—Renee S. Luebke
*Attorney, Agent, or Firm*—M. J. Moran

[57] ABSTRACT

A snap action operating mechanism for electrical switches and the like includes a hollow cylindrical housing closed at the ends. A rod extends through one end and is slidable within the housing, while the opposite end of the housing is connected to the switch to be operated. A trip bar projects radially outward in diametrically opposed directions from the rod through longitudinal slots in the housing. A pair of compression springs are disposed within the housing, one on each side of the trip bar. Latch units, each comprising a pair of pivoted latch members, alternately engage opposite ends of the housing to restrain movement of the housing in that direction. Thus, initial longitudinal movement of the rod in the direction of the engaged latch unit results in compression of one of the springs until the trip bar engages a camming surfaces on the engaged latch members, and rotates them clear of the housing. The housing is then accelerated rapidly by the energy stored in the compressed spring. The other latch unit then engages the other end of the housing for similar linear snap action when the rod is moved in the opposite direction.

6 Claims, 5 Drawing Sheets

LINEAR SNAP ACTION OPERATING MECHANISM AND AN ELECTRICAL SWITCH INCORPORATING SAME

BACKGROUND OF THE INVENTION

1. Field of Invention

This invention relates to mechanisms for providing linear snap action. More particularly, it relates to such mechanisms which provide snap action and develop the mechanical forces required to rapidly make and break the contacts in electrical switches. It has particular application as an operating mechanism for isolating switches in medium voltage motor starters.

2. Background Information

Electrical switches used for connecting and disconnecting electrical components from medium voltage power sources require a mechanism for developing the high mechanical forces required to open and close the switch contacts.

An example of such a switch is the isolating switch in a motor starter for medium voltage (2300–7200 volt) motors. A motor starter incorporating such an isolating switch is disclosed in U.S. Pat. No. 4,086,452. This starter includes a contactor which performs the normal switching functions of the starter and fuses for overcurrent protection. The isolating switch is provided to remove power from the line side of the components in the starter unit for maintenance.

The isolating switch makes and breaks contact between a set of three-phase moveable stab contacts and the three-phase line terminal assemblies. The stab contacts are mounted on a sliding tray and are integral with fuse clips gripping one end of power fuses which are pivoted by movement of the tray. The tray is advanced to close the contacts of the isolating switch and retracted to open them by a handle on the outside of the starter unit through a connecting rod. Considerable mechanical force is required to accelerate the mass of the tray, the attached stab contacts, and the pivoted power fuses and to engage and disengage the stab contacts in the line terminal assemblies. While the main current is disconnected by the contactor before the isolating switch is operated, some current is drawn through the isolating switch with the contactor open to provide primary exitation for the control transformer supplying power to the control circuits for the contactor, and for a metering transformer which monitors voltage and other parameters for performing the overload function. However, the isolating switch is not provided with arc extinguishers. It can be appreciated therefore, that sizeable mechanical forces must be developed to operate the isolating switch, and that the switch must be operated rapidly to avoid damage due to arcing.

Snap acting mechanisms have been used elsewhere to rapidly generate sizeable mechanical forces. However, these devices commonly utilize an over center toggle, or rotary motions or a combination of both. Space limitations in the starter unit preclude use of such devices in this application.

There is a need therefore for an improved operating mechanism for electrical switches which can generate the sizeable mechanical forces required to operate the switch, with rapid engagement and disengagement of the electrical contacts.

More particularly, there is a need for an improved snap action mechanism for operating electrical switches.

There is a further need for such mechanisms which are compact and which preferably utilize linear motion.

There is a specific need for such a mechanism for the isolating switch for medium voltage motor starter.

There is a subordinate need for such a mechanism which is simple and reliable, and can be readily adapted to existing isolating switches.

SUMMARY OF THE INVENTION

These and other needs are satisfied by the invention which is directed to a snap action operating mechanism useful for instance in operating a switch, such as, for example, the isolating switch in a motor starter. The mechanism includes a housing with an elongated, internal chamber. A rod extending through the housing is slidable longitudinally within the chamber to load one of a pair of springs when moved linearly in one direction and to load the other spring when moved linearly in the opposite direction. Preferably, the springs are compression springs. Latching means are moveable between a latched position in which movement of the housing in response to movement of the rod is prevented and an unlatched position in which the housing is released to move longitudinally. Trip means carried by the rod move the latch means from the latched position to the unlatched position at predetermined points of travel of the rod.

The housing is connected to the moving contacts of the switch. When the rod is moved in a first direction with the latching means in a latched position preventing movement of the housing in that direction, the one spring is loaded until the latching means is unlatched by the trip means. This releases the housing which is accelerated in the first direction by the loaded spring to rapidly drive the first contacts into engagement with the second, fixed contacts. When the rod is moved in the opposite direction with the latching means in the latched position to prevent movement of the housing in that direction, the other spring is loaded. When the trip means moves the latch means to the unlatched position, the housing is released and accelerated in the opposite direction by the loaded other spring to rapidly drive the first contacts out of engagement with the fixed contacts.

In the preferred embodiment of the invention, the latching means includes separate pivotally mounted latch units for preventing movement of the housing in the two directions. Preferably each of the latch units includes a pair of latch members pivotally mounted on opposite sides of the housing and biased toward each other by a spring so that latch bars on the ends of the latch members engage the associated end of the housing.

Preferably the trip means comprises projections extending radially outward through longitudinal slots in the housing which engage camming surfaces on the pivoted latch members. In the preferred form, each latch member is generally U-shaped and comprises the latch bar and a pair of parallel support arms extending transversely from opposite ends of the latch bar. One the support arms has a lobe projecting toward the other latch member of the pair which defines the camming surface The other of the support arms has a complimentary recess which, with the pair of latch members pivotally mounted on opposite sides of the housing in a confronting relation, receives the lobe projecting from the one support arm of the other latch member of the pair. This arrangement provides better lead in for the trip means to actuate the latch unit from the latched to the unlatched position thereby releasing the housing for acceleration by the compressed spring.

In the exemplary embodiment of the invention, the latch members from the two units which are on the same side of the housing are pivoted on a common pivot axis.

The invention provides snap acting mechanism which operates with linear input and linear output. Such a configuration is very space efficient. As will be seen, this novel mechanism provides a built-in backup system for switching the contacts to "off" should the latching means not hold the spring housing.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

The invention has application as an operating mechanism for various types of devices including switching apparatus. However, it is particularly suitable for isolating switches used in contactors and will be described as applied to a contactor such as the motor starter disclosed in U.S. Pat. No. 4,086,452. That patent and U.S. Pat. No. 3,264,431 may be referred to for a complete description of the motor starter. Only those portions of the motor starter necessary to an understanding of the present invention will be discussed in detail herein.

Figure 1:
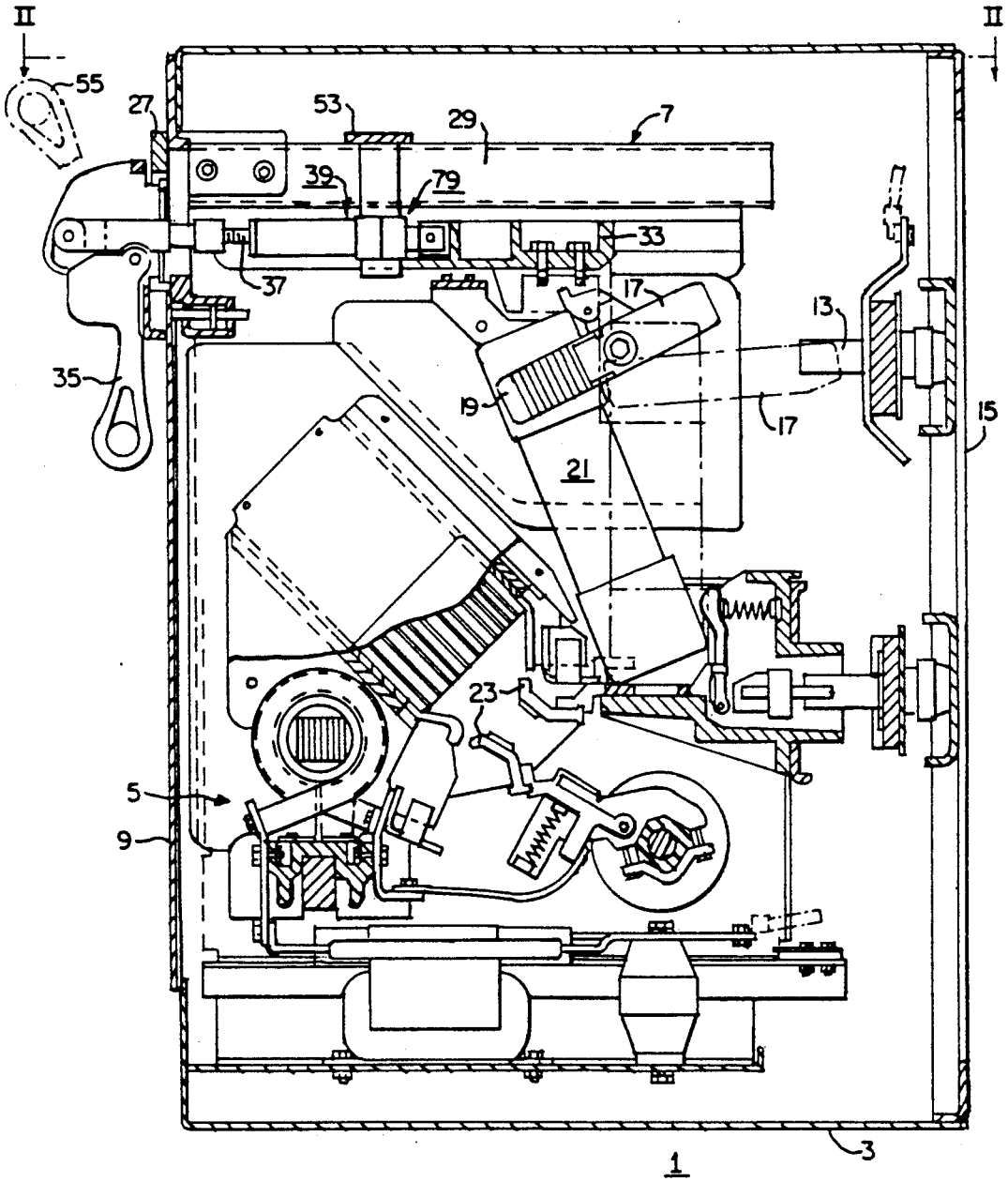
FIG. 1 is a vertical sectional view through a motor starter having an isolating switch incorporating the present invention.

FIG. 1 illustrates a medium voltage motor starter 1 which comprises a cabinet housing 3 in which high-voltage, modular plug-in assemblies are arranged The plug-in assemblies include a contactor unit 5, and an isolating switch 7 each of which is slidably removable from the cabinet housing 3 through hinged access door 9. Electrical terminal assemblies 13 mounted on the interior surface of a rear panel 15, electrically engage the isolation switch 7. Three-phase line power supplied to the line terminal assemblies 13 is conducted through stab contacts 17, conductive fuse clips 19, and power fuses 21 to the contacts 23 of the contactor unit 5.

The contactor unit 5 opens and closes the contacts 23 to perform the normal switching functions of the motor starter 1. This includes starting and stopping the motor and overcurrent protection.

The isolating switch unit 7 disconnects power from all the components in the motor starter unit except the line terminal assemblies 13 so that maintenance can be performed within the cabinet safely Although not disclosed herein for clarity, a shutter assembly described in U.S. Pat. No. 4,086,452 is operated by the isolating switch to enclose the line terminal assemblies 13 when the isolating switch is open to preclude inadvertent contact with these energized components.

Figure 2:
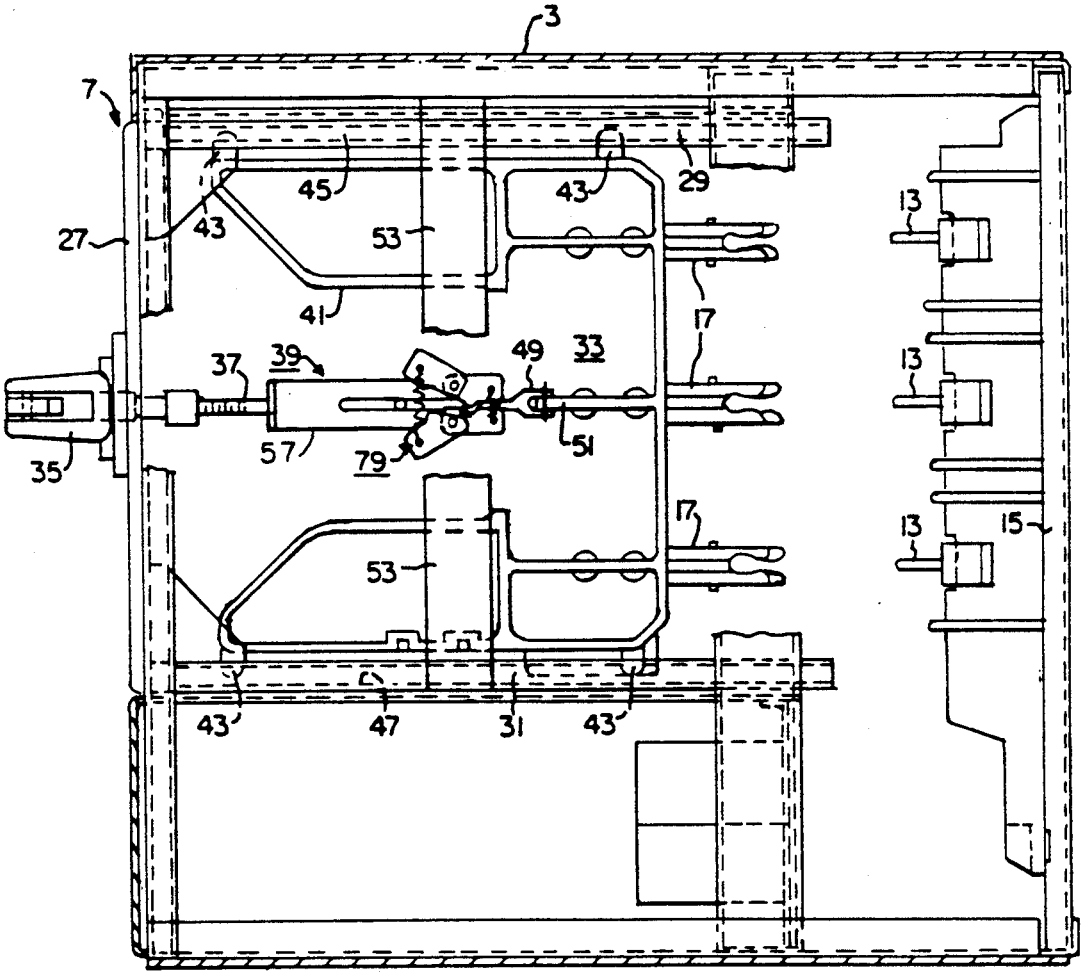
FIG. 2 is a horizontal sectional view taken along the line II—II in FIG. 1 showing the isolating switch in the open position.

Referring additionally to FIG. 2, the isolating switch unit 7 comprises a frame including a front panel 27, a pair of side plates 29 and 31, a tray or carrier 33, a handle 35, and a connecting rod 37 extending from the handle 35 to a snap action operating mechanism 39 connected to the tray 33.

Figure 3:
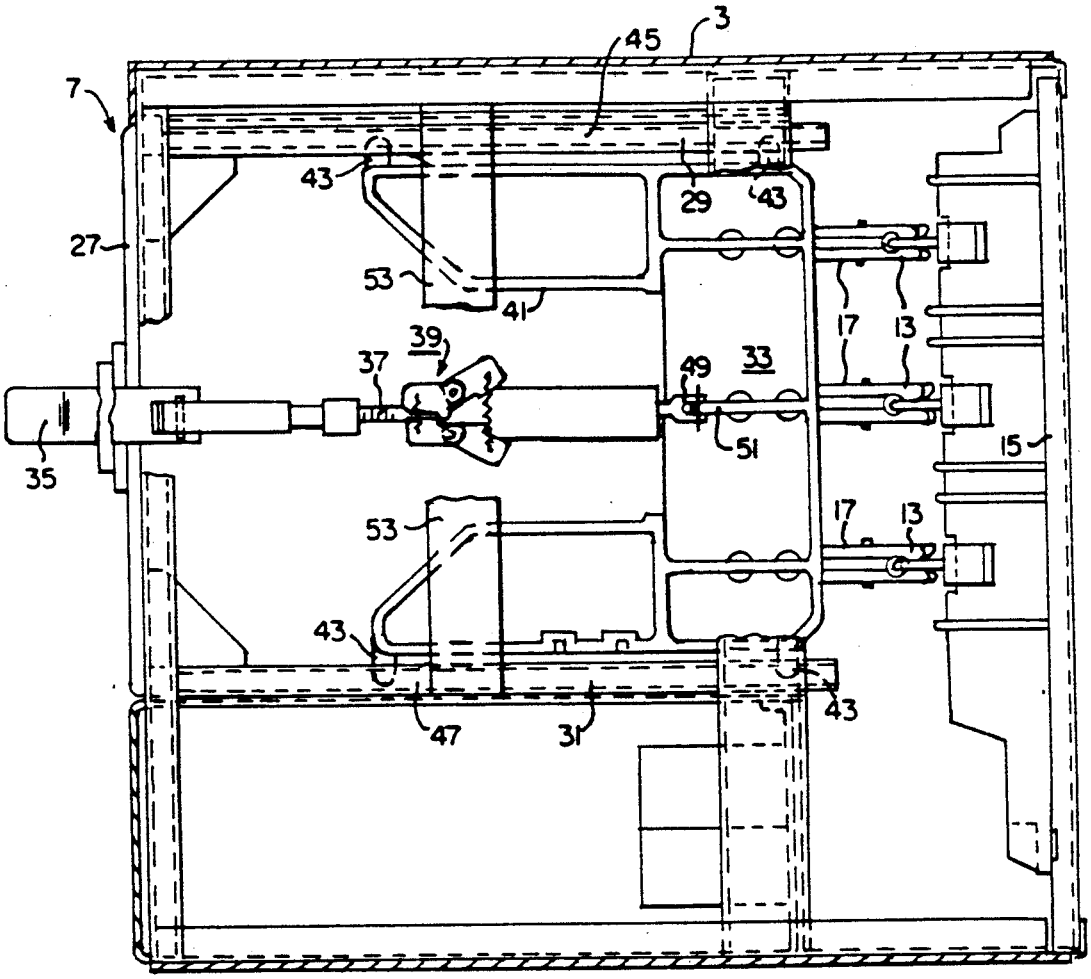
FIG. 3 is a horizontal sectional view corresponding to FIG. 2 showing the isolating switch in the closed position.

Referring additionally to FIG. 3, the primary function of the isolating switch 7 is to make and break contact between the stab contacts 17 and the line terminal assemblies 13. For that purpose the power fuses 21 are moved from the solid position shown in FIG. 1 (and the position of the isolating switch shown in FIG. 2.) to the broken line position thereof with the stab contacts 17 shown in broken line contact with the line terminal assemblies 13 (as also shown in FIG. 3). The stab contacts 17 and the power fuses 21 are moved between these two positions by movement of the tray 33 of the isolation switch. With the tray retracted as shown in FIG. 2, the isolating switch is open. With the tray fully inserted as shown in FIG. 3, the isolating switch is closed.

The tray or carriage 33 is substantially rectangular with an indentation 41 in the front side. Lateral projections 43 on the sides of the tray 33 are engaged in track-like grooves 45 and 47 in the side panels 29 and 31 respectively.

The snap action operating mechanism 39 is connected to a raised rib 51 on the tray at the center of the indentation 41 by a cleavis 49. As discussed more fully below, portions of the snap action operating mechanism 39 are suspended from a support member 53 extending between the size panels 29 and 31. The rod 37 is connected to the handle 35. With the handle in the full line position shown in FIG. 1, the tray 33 is retracted by the rod 37 as shown in FIG. 2. When the handle is rotated to the broken line position 55 shown in FIG. 1, the rod 37 is linearly advanced to move the tray 33 to the closed position shown, in FIG. 3

Figure 6:
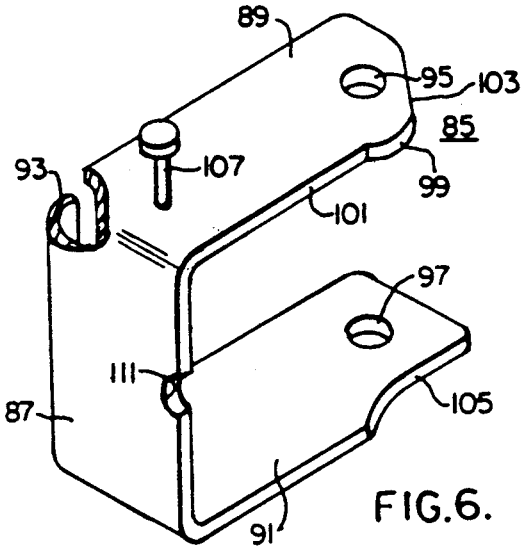
FIG. 6 is a isometric view with part cut away of a latch member which forms part of the switch operating mechanism of the invention.
Figure 4:
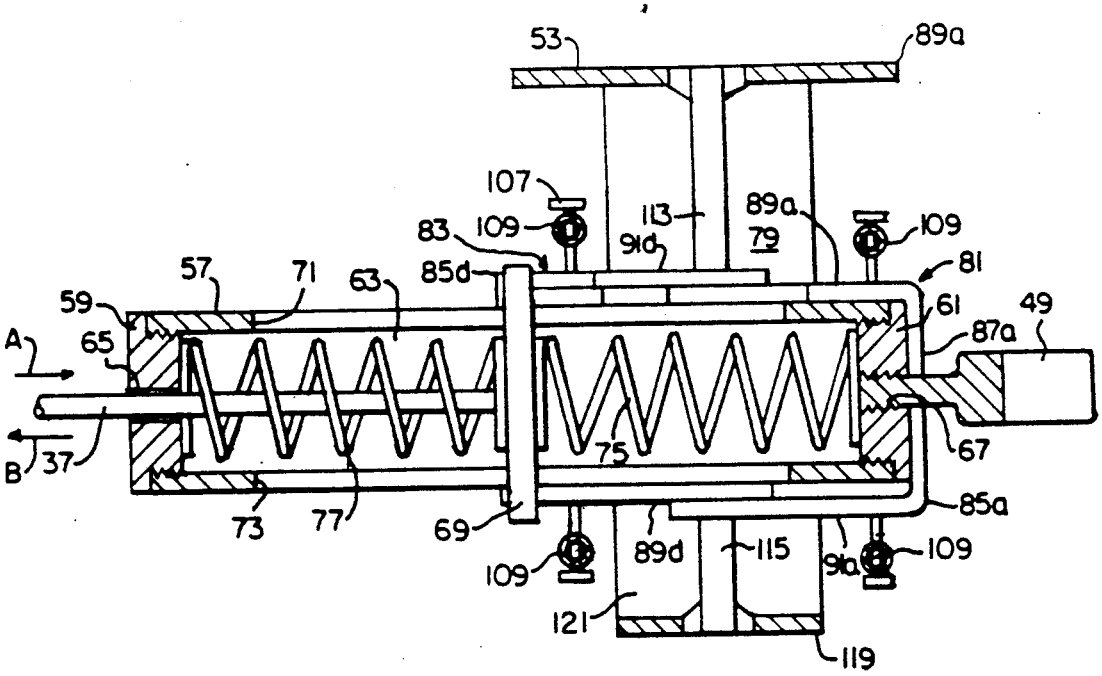
FIG. 4 is an enlarged vertical section through the switch operating mechanism of the invention taken along the line IV—IV of FIG. 5.
Figure 5:
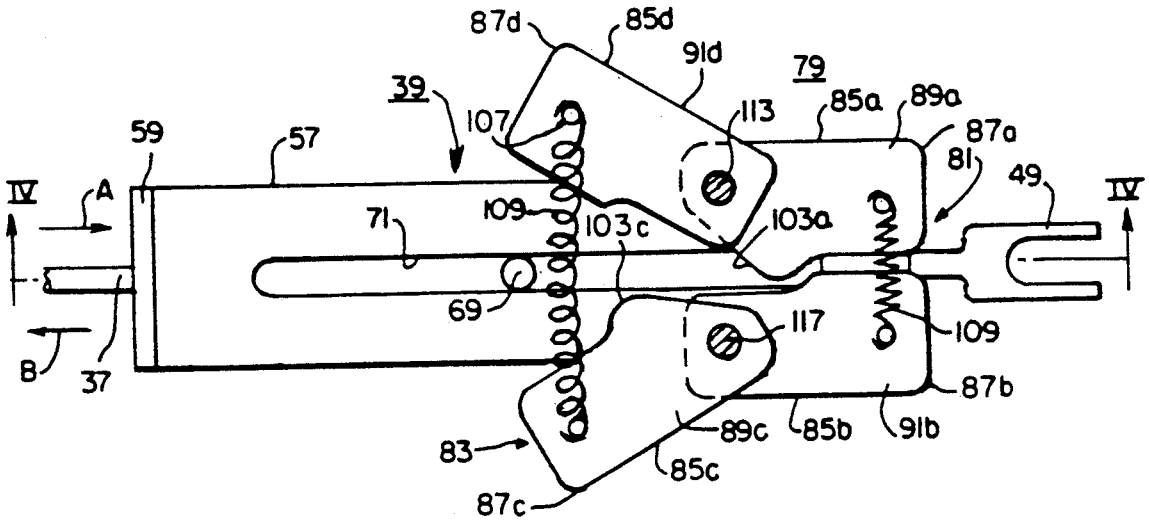
FIG. 5 is an enlarged horizontal view of the switch operating mechanism of FIG. 2.

Referring additionally to FIGS. 4, 5 and 6, the snap action operating mechanism 39 is shown in includes a tubular housing 57 having plugs 59 and 61 threaded into the ends to form an elongated internal chamber 63. The rod 37 extends through a bore 65 in the plug 59 longitudinally into the chamber 63. The cleavis 49 is threaded into a bore 67 in the other plug 61. A trip mechanism in the form of a bar 69 extending transversely from the end of the rod 37 projects laterally outward through diametrically opposed longitudinal slots 71 and 73 in the housing 57. A first compression spring 75 is disposed within the chamber 63 between the plug 61 and the bar 69. A second compression spring 77 is disposed around the rod 37 between the plug 59 and the bar 69.

Movement of the housing 57 is restricted by a latching mechanism 79. The latching mechanism 79 comprises two latching units; latching unit 81 which restricts movement of the housing 57 in a first direction A which is to the right as viewed in FIGS. 4 and 5, and latching unit 83 which restricts housing movement in a second direction B which is to the left. Each latch unit includes a pair of latch members 85 which are best seen in FIG. 6. Latch members 85 are U-shaped members having a latch bar 87 and a pair of parallel support arms 89 and 91 extending transversely from opposite ends of the latch bar 87. An extension 93 of the latch bar extends transversely between the support arms 89 and 91 to provide rigidity to the structure. The support arms 89 and 91 are provided with concentric mounting holes 95 and 97 near their free ends. The support arm 89 has a lobe 99 projecting from the side edge 101 to form a camming surface 103. The other support arm 91 has a recess 105 complimentary to the projecting lobe on the arm 89. Pins 107 projecting laterally from the arms 89 and 91 form supports for biasing springs 109 (see FIG. 5). Semicircular notches 111 in the latch bars 87 form apertures for the rod 37 and cleavis 49.

Since the latch members 85 making up the latch units 81 and 83 are identical, they are identified as 85*a* and 85*b* associated with latch member 81, and 85*c* and 85*d* associated with latch unit 83. As can be seen from FIG. 5, the pair of latch members making up each latch unit are disposed on opposite sides of the housing 57. Due to the asymmetry of the latch members 85, it can be seen that the support arm 89*a* of the latch member 85*a* confronts the support arm 91*b* of latch member 85*b* above the housing 57. From FIG. 4, it can be appreciated that the support arm 91*a* confronts the support arm 89*b* (not shown in FIG. 4) below the housing. Similarly, the support arm 89*c* confronts the support arm 91*d* above the housing 57, while the support arm 89*d* faces the support arm 91*c* (not shown), below the housing.

The support arms 89*a* and 91*d* are mounted for pivotal movement on a common support shaft 113 which is received in the mounting holes 95. Similarly, the other support arms 91*a* and 89*d* of the latch members 85*a* and 85*d* are supported by a lower pivot shaft 115. In like manner, the support arms 91*b* of latch member 85*b* and support arm 89*c* of latch member 85*c* are supported by a common upper pivot shaft 117. Another common pivot shaft (not shown) mounts the lower support arms 89*b* and 91*c* of the latch members 85*b* and 85*c* below the housing 57. The support shafts 113 and 117 depend from the support member 53. The support shaft 115 and the remaining support shaft are mounted on a lower support member 119 which is suspended from the support member 153 by vertical members 121.

Figure 7:
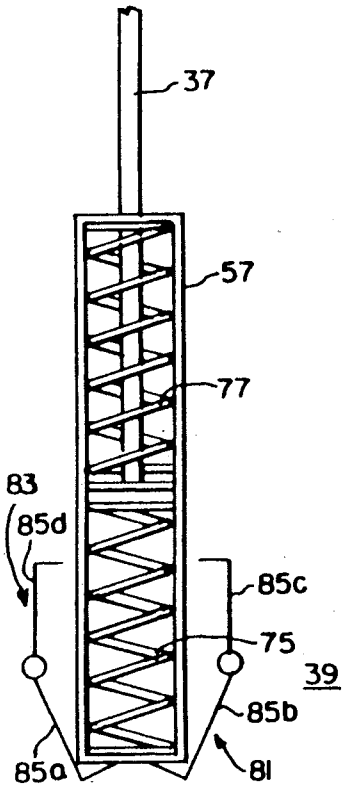
FIG. 7 is a schematic view of the switch operating mechanism with the isolating switch in the OFF condition.

Referring additionally to FIGS. 7 through 10, operation of the snap action mechanism of the invention can be understood. In FIGS. 7 through 10, the latching units are shown schematically for clarity. The detailed position of the various components can be realized from associating the position depicted in the schematic figures with the detailed structures shown in FIGS. 4 and 5. FIGS. 4, 5 and 7 all show the snap action operating mechanism 39 for the off position of the isolating switch 7. In this condition, the handle 35 is in the full line position shown in FIG. 1 and the tray 33 is retracted so that the stab contacts 17 are disconnected from the line terminal assemblies 13 as shown in FIG. 3. The latch unit 81 engages the right end (as seen in FIGS. 2, 4 and 5) of the housing 57, and the rod 37 is inserted halfway into the chamber 63 so that neither of the springs 75 or 77 is loaded. The springs 109 maintain the latch bars 87*a* and 87*b* in engagement with the end of the housing 57.

Figure 8:
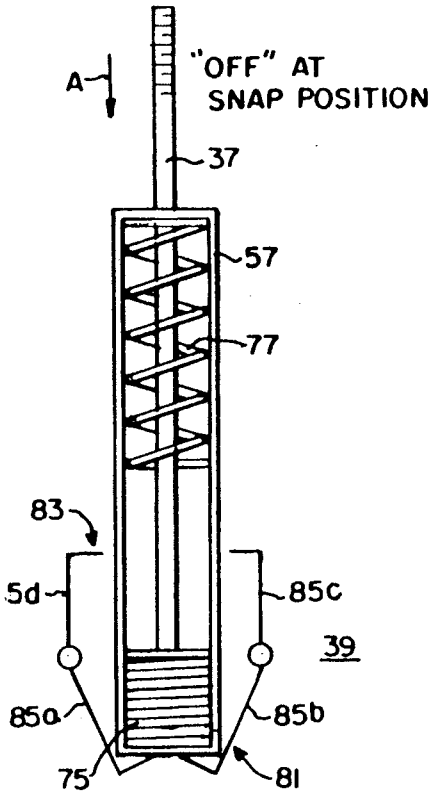
FIG. 8 is a schematic diagram of the switch operating mechanism in the SNAP position with the isolating switch in the OFF condition.

When it is desired to close the isolating switch 7, the handle 35 is rotated from the position shown in full line in FIG. 1 toward the position 55 shown in broken line. Due to the pivoting connection of the rod 37 to the handle mechanism, the rod is moved longitudinally in the direction of the arrow A. This movement is resisted by the latch unit 81 which prevents the housing 57 from moving in the direction A so that the rod 37 moves relative to the housing 57 and compresses spring 75 as shown in FIG. 8. The pin 69 moves with the rod 37 and as the spring 75 approaches full compression, pin 69 engages the camming surface 103*a* on the latch member 85*a*. The other end of the rod 69 simultaneously engages the camming surface 103*b* (not shown) on the latch unit 85*b*. Continued movement of the rod 37 in the direction of arrow A causes the latch members 85*a* and 85*b* to pivot away from each other against the biasing force of the springs 109 until the latch bars 87*a* and 87*b* release the housing. The housing, and together with it the tray 33 and stab contacts 13, are accelerated by the energy stored in the compressed spring 75 to drive the stab contacts into engagement with the line terminal assembly 13 as shown in FIG. 3. This brings the snap action mechanism 39 to the position shown in FIG. 9 wherein the left end of the housing 57 as viewed in FIGS. 4 and 5 is engaged by the latch bars 87*c* and 87*d* of the latch members 85*c* and 85*d*. The handle 35 is now in the dashed line position shown in FIG. 1. In this position of the snap action operating mechanism 39, neither of the springs 75, 77 is compressed.

Figure 10:
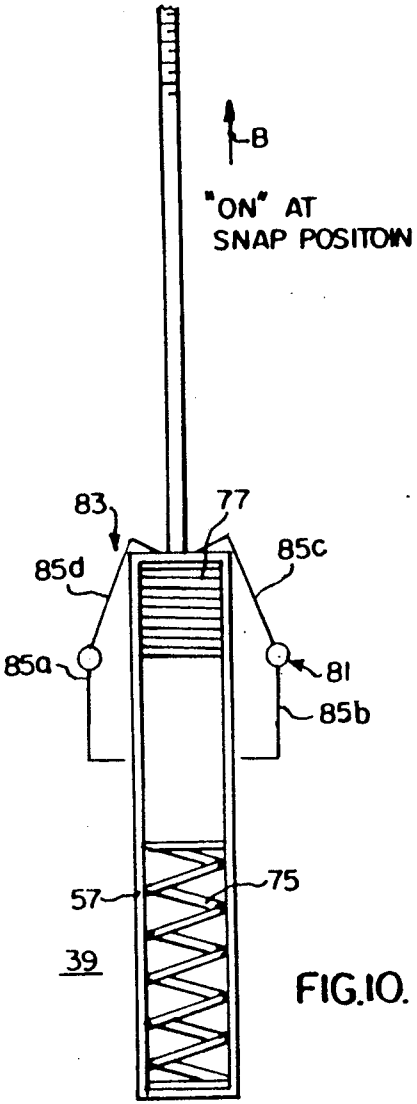
FIG. 10 is a schematic diagram of the switch operating mechanism in the SNAP position with the isolating switch in the ON condition.
Figure 9:
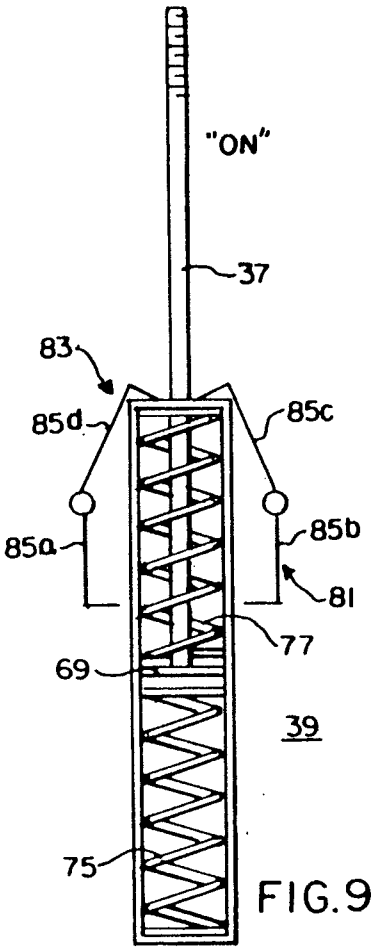
FIG. 9 is a schematic diagram of the switch operating mechanism with the isolating switch in the ON condition.

When it is desired to open the isolation switch, the handle 35 is rotated downward from the broken line position shown in FIG. 1 toward the full line position. This causes the rod 37 to move in the direction B. Since the housing 57 is restrained from movement with the rod by the latch unit 83, the spring 77 is compressed as shown in FIG. 10. When the rod 69 engages the camming surfaces 103*c* and 103*d* (not shown) to rotate the latch members 85*c* and 85*d* out of engagement with the end of the housing 57, the housing and the tray 33 carrying the stab contacts 13 are rapidly accelerated in the direction of arrow B by the energy stored in compressed spring 77 to disengage the stab contacts 13 from the line terminal assemblies 13 thus opening the isolating switch 7.

The energy stored in the springs 75 and 77 is sufficient to rapidly develope the high mechanical forces needed to move the stab contacts 17 into and out of engagement with the line terminal assemblies 13. This is achieved by a compact device which operates with linear input and linear output and thus requires minimal space. The device also provides a built in backup system for switching the isolating switch OFF should the latch unit 83 not hold the spring housing during initial withdrawal of the rod 37. If the static force of friction between the stab contacts 17 and the line terminal assemblies 13 were to be greater than the maximum spring compression force, the spring 77 would fully compress and then the device would act like a solid linkage to disengage the contacts. However, this case is very unlikely. More likely, the static spring force would be greater than the static friction force between the stab contact 17 and the line terminal assemblies 13, and hence the contacts would disengage when the spring force exceeded the static force of friction. In either case however, the switch would disengage.

Figure 11:
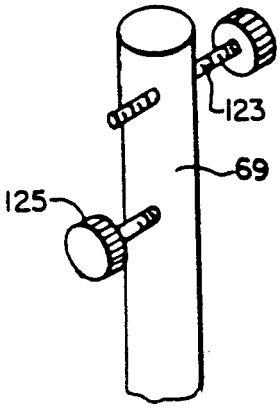
FIG. 11 is an isometric view, part broken away of portion of trip member 69.

FIG. 11 illustrates a means for adjusting the points in the two directions A and B at which the snap action is initiated. As indicated, a trigger pin 123 threaded into the trip bar 69 adjusts the point in the travel of rod 37 at which the latch unit 81 releases the housing 57. A separately adjustable trigger pin 125 can be positioned relative to the trip bar 69 to independently adjust the point at which the latch unit 83 releases the housing for opening the switch. The laterally projecting lobes 99 on the latch members 85 which extend the camming surfaces 103 over the center lines of the slots 71 and 73 provide better lead in for unlatching the latching members by the trip bar 69 with or without the adjustable trigger pins 123 and 125.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An operating mechanism for an electrical switch having first contact means which are movable into and out of engagement with second contact means, said mechanism comprising:

a housing having an elongated internal chamber and an elongated slot;

a rod extending through said housing longitudinally into said elongated internal chamber and longitudinally slidable relative to said elongated internal chamber;

a pair of compression springs in said elongated internal chamber, one of which is loaded by movement of said rod in a first direction and the other of which is loaded by movement of the rod in the opposite direction;

latching means for movement between a latched position in which movement of said housing in correspondence with movement of said rod is prevented and an unlatched position in which the housing is released to move longitudinally, said compression springs being loaded in compression by movement of said rod with said housing in the latched position;

trip means carried by said rod projecting radially outward from said rod through said elongated slot for moving said latching means from the latched position to the unlatched position at a predetermined point of travel of said rod;

connecting means for connecting said housing to said first contact means; and handle means connected to said rod for moving said rod in said first direction with said latching means in the latched position thus preventing movement of said housing to thus load said one spring until said trip means moves said latching means to the unlatched position thus releasing said housing which in turn is accelerated in said first direction by said one spring to rapidly drive said first contact means into engagement with said second contact means, and for moving said rod in the opposite direction with said latching means in said latched position thus preventing movement of said housing to thus load the other spring until said trip means moves said latching means to the unlatched position thus releasing said housing which in turn is accelerated by said other spring to rapidly withdraw said first contact means from engagement with said second contact means;

said latching means comprising: a first latch unit, first mounting means mounting said first latch unit for pivotal movement between said latched position in which said first latch unit engages and prevents movement of said housing in said first direction and said unlatched position in which said housing is free to move in said first direction; a second latch unit, second mounting means mounting said second latch unit for pivotal movement between said latched position in which said second latch unit engages and prevents movement of said housing in said opposite direction, and said unlatched position in which said housing is free to move in said opposite direction; and biasing means biasing said first and second latch units to said latched positions, said trip means engaging said first and second latch units and pivoting them to their unlatched positions when the rod reaches predetermined points of travel in said first and opposite directions respectively; and said trip means including adjustment means connected to said radial projections movable generally parallel to said rod to adjust the points in rod travel in said first and opposite directions, and hence the amount of spring compression at which said first and second latch units respectively are moved to their unlatched positions.

2. An operating mechanism for an electrical switch having first contact means which are movable into and out of engagement with second contact means, said mechanism comprising:

a housing having an elongated internal chamber;

a rod extending through said housing longitudinally into said elongated internal chamber and longitudinally slidable relative to said elongated internal chamber;

a pair of compression springs in said elongated internal chamber, one of which is loaded by movement of said rod in a first direction and the other of which is loaded by movement of the rod in the opposite direction;

latching means for movement between a latched position in which movement of said housing in correspondence with movement of said rod is prevented and an unlatched position in which the housing is released to move longitudinally, said compression springs being loaded in compression by movement of said rod with said housing in the latched position;

trip means carried by said rod for moving said latching means from the latched position to the unlatched position at predetermined points of travel of said rod;

connecting means for connecting said housing to said first contact means; and handle means connected to said rod for moving said rod in said first direction with said latching means in the latched position thus preventing movement of said housing to thus load one said spring until said trip means moves said latching means to the unlatched position thus releasing said housing which in turn is accelerated in said first direction by said one spring to rapidly drive said first contact means into engagement with said second contact means, and for moving said rod in the opposite direction with said latching means in said latched position thus preventing movement of said housing to thus load the other spring until said trip means moves said latching means to the unlatched position thus releasing said housing which in turn is accelerated by said other spring to rapidly withdraw said first contact means from engagement with said second contact means;

said latching means comprising: a first latch unit, first mounting means mounting said first latch unit for pivotal movement between said latched position in which said first latch unit engages and prevents movement of said housing in said first direction and said unlatched position in which said housing is free to move in said first direction; a second latch unit, second mounting means mounting said second latch unit for pivotal movement between said latched position in which said second latch unit engages and prevents movement of said housing in said opposite direction, and said unlatched position in which said housing is free to move in said opposite direction; and biasing means biasing said first and second latch units to said latched positions, said trip means engaging said first and second latch units and pivoting them to their unlatched positions when the rod reaches predetermined points of travel in said first and opposite directions respectively;

said first and second latch units each comprising a pair of latch members with the members of said pair disposed on opposite sides of said housing, and wherein, said first and second mounting means comprise pivot shafts on said opposite sides of said housing about which said latch members are pivoted, said latch member each having a latch bar which, with said latch members rotated toward each other to the latched position, engages an end of said housing to prevent movement of said housing in the direction of that end of the housing;

said housing defines a longitudinal slot, wherein said trip means comprises a radial projection extending radially outward from said rod through said slot, and wherein said latch members have camming surfaces, said radial projection engaging a camming surface as said rod moves in a direction toward the end of said housing engaged by the latch members and pivoting said latch members from the latched position away from each other to the unlatched position in which the latch bars on said latch members are disengaged from said housing; and wherein each latch member is generally U-shaped and comprises said latch bar and a pair of substantially parallel support arms extending transversely from opposite ends of said latch bar, said support arms having coaxial bores spaced from the latch bar about which said latch member is pivoted, one of said support arms having a lobe projecting toward the other latch member of the pair and defining said camming surface, the other of said support arms having a complimentary recess which, with the pair of latch members pivotally mounted on opposite sides of said housing in confronting relation, receives said lobe projecting from said one support arm of the other latch member of said pair.

3. A snap action operating mechanism comprising:

a housing having an elongated internal chamber;

a rod extending through said housing longitudinally into said elongated internal chamber and longitudinally slidable relative to said elongated internal chamber;

a pair of compressions springs in said elongated internal chamber, one of which is loaded by movement of said rod in a first direction and the other of which is loaded by movement of the rod in the opposite direction;

a first latch unit mounted for pivotal movement between a latched position in which said first latch unit engages and prevents movement of said housing in said first direction and an unlatched position in which said housing is free to move in said first direction;

a second latch unit mounted for pivotal movement between a latched position in which said second latch unit engages and prevents movement of said housing in said opposite direction, and an unlatched position in which said housing is free to move in said opposite direction;

biasing means for biasing said first and second latch units toward said latched positions;

trip means carried by said rod for moving said first and second latch units from said latched positions to said unlatched positions at predetermined points of travel of said rod;

said rod being movable in said first direction with said first latch unit in said latched position thus preventing movement of said housing in the first direction to load said one spring until said trip means moves said first latch unit to said unlatched position thus releasing said housing which in turn is accelerated in said first direction by said one spring, and said rod being movable in the opposite direction with said second latch unit in said latched position thus preventing movement of said housing in said opposite direction to load said other spring until said trip means moves said second latch unit to said unlatched position thus releasing said housing which in turn is accelerated by said other compression spring in said opposite direction;

said first and second latch units each comprising a pair of latch members with the member of said pair pivotally mounted on opposite sides of said housing, said latch members each having a latch bar which, with said latch members rotated toward each other to the latched position, engages an end of said housing to prevent movement of said housing in the direction of that end of the housing;

said housing defining a longitudinal slot, wherein said trip means comprises a radial projection extending radially outward from said rod through said slot, and wherein said latch members have camming surfaces, said radial projection engaging said camming surfaces as said rod moves in a direction toward the end of said housing engaged by the latch members and pivoting said latch members from the latched position away from each other to the unlatched position in which the latch bars on said latch members are disengaged from said housing; and each latch member being generally U-shaped and comprising said latch bar and a pair of substantially parallel support arms extending transversely from opposite ends of said latch bar, said support arms having coaxial bores spaced from the latch bar about which said latch member is pivoted, one of said support arms having a lobe projecting toward the other latch member of the pair and defining said camming surface, the other of said support arms having a complimentary recess which, with the pair of latch members pivotally mounted on opposite sides of said housing in confronting relation, receives said lobe projecting from said one support arm of the other latch member of said pair.

4. An operating mechanism for an electrical switch having first contact means which are movable into and out of engagement with second contact means, said mechanism comprising:

a housing having an elongated internal chamber;

a rod extending through said housing longitudinally into said elongated internal chamber and longitudinally slidable relative to said elongated internal chamber;

a pair of compression springs in said elongated internal chamber, one of which is loaded by movement of said rod in a first direction and the other of which is loaded by movement of the rod in the opposite direction;

latching means movable between a latched position in which movement of said housing with said rod is prevented and an unlatched position in which the housing is released to move longitudinally, said compression springs being loaded in compression by movement of said rod with said housing in the latched position;

trip means carried by said rod moving said latching means from the latched position to the unlatched position at predetermined points of travel of said rod;

means connecting said housing to said first contact means;

handle means connected to said rod for moving said rod in said first direction with said latching means in the latched position preventing movement of said housing to load one spring until said trip means moves said latching means to the unlatched position releasing said housing which in turn is accelerated in said first direction by said one spring to rapidly drive said first contact means into engagement with said second contact means, and for moving said rod in the opposite direction with said latching means in said latched position preventing movement of said housing to load the other spring until said trip means moves said latching means to the unlatched position releasing said housing which in turn is accelerated by said other spring to rapidly withdraw said first contact means from engagement with said second contact means;

said latching means comprising:

a first latch unit, first mounting means mounting said first latch unit for pivotal movement between said latched position in which said first latch unit engages and prevents movement of said housing in said first direction and said unlatched position in which said housing is free to move in said first direction;

a second latch unit, second mounting means mounting said second latch unit for pivotal movement between said latched position in which said second latch unit engages and prevents movement of said housing in said opposite direction, and said unlatched position in which said housing is free to move in said opposite direction;

biasing means biasing said first and second latch units to said latched positions, said trip means engaging said first and second latch units and pivoting them to their unlatched positions when the rod reaches predetermined points of travel in said first and opposite directions, respectively;

said first and second latch units each comprising a pair of latch members with the member of said pair disposed on opposite sides of said housing, and wherein, said first and second mounting means comprise pivot shafts on said opposite side of said housing about which said latch members are pivoted, said latch members each having a latch bar which, with said latch members rotated toward each other to the latched position, engages an end of said housing to prevent movement of said housing in the direction of that end of the housing; and said housing defines a longitudinal slot, wherein said trip means comprises a radial projection extending radially outward from said rod through said slot, and wherein said latch members have camming surfaces, said radial projection engaging said camming surfaces as said rod moves in a direction toward the end of said housing engaged by the latch members and pivoting said latch members from the latched position away from each other to the unlatched position in which the latch bars on said latch members are disengaged from said housing.

5. An operating mechanism for an electrical switch having first contact means which are movable into and out of engagement with second contact means, said mechanism comprising;

a housing having an elongated internal chamber;

a rod extending through said housing longitudinally into said elongated internal chamber and longitudinally slidable relative to said elongated internal chamber;

a pair of compression springs in said elongated internal chamber, one of which is loaded by movement of said rod in a first direction and the other of which is loaded by movement of the rod in the opposite direction;

latching means movable between a latched position in which movement of said housing with said rod is prevented and an unlatched position in which the housing is released to move longitudinally, said compression springs being loaded in compression by movement of said rod with said housing in the latched position;

trip means carried by said rod moving said latching means from the latched position to the unlatched position at predetermined points of travel of said rod;

means connecting said housing to said first contact means;

handle means connected to said rod for moving said rod in said first direction with said latching means in the latched position preventing movement of said housing to load one spring until said trip means moves said latching means to the unlatched position releasing said housing which in turn is accelerated in said first direction by said one spring to rapidly drive said first contact means into engagement with said second contact means, and for moving said rod in the opposite direction with said latching means in said latched position preventing movement of said housing to load the other spring until said trip means moves said latching means to the unlatched position releasing said housing which in turn is accelerated by said other spring to rapidly withdraw said first contact means from engagement with said second contact means;

said latching means comprising:

a first latch unit, first mounting means mounting said first latch unit for pivotal movement between said latched position in which said first latch unit engages and prevents movement of said housing in said first direction and said unlatched position in which said housing is free to move in said first direction;

a second latch unit, second mounting means mounting said second latch unit for pivotal movement between said latched position in which said second latch unit engages and prevents movement of said housing in said opposite direction, and said unlatched position in which said housing is free to move in said opposite direction;

biasing means biasing said first and second latch units to said latched positions, said trip means engaging said first and second latch units and pivoting them to their unlatched positions when the rod reaches predetermined points of travel in said first and opposite directions, respectively;

said first and second latch units each comprising a pair of latch members with the members of said pair disposed on opposite sides of said housing, and wherein said first and second mounting means comprise pivot shafts on said opposite sides of said housing about which said latch members are pivoted, said latch members each having a latch bar which, with said latch members rotated toward each other to the latched position, engages an end of said housing to prevent movement of said housing in the direction of that end of the housing;

said housing defines a longitudinal slot, wherein said trip means comprises a radial projection extending radially outward from said rod through said slot, and wherein said latch members have camming surfaces, said radial projection engaging said camming surfaces as said rod moves in a direction toward the end of said housing engaged by the latch members and pivoting said latch members from the latched position away from each other to the unlatched position in which the latch bars on said latch members are disengaged from said housing; and wherein said first and second mounting means comprise on each of said opposite sides of said housing common pivot shafts about which one of said pair of latch members from each of said first and second latch units are pivoted.

6. A snap action operating mechanism comprising:

a housing having an elongated internal chamber;

a rod extending through said housing longitudinally into said elongated internal chamber and longitudinally slidable relative to said elongated internal chamber;

a pair of compression springs in said elongated internal chamber, one of which is loaded by movement of said rod in a first direction and the other of which is loaded by movement of the rod in the opposite direction;

a first latch unit mounted for pivotal movement between a latched position in which said first latch unit engages and prevents movement of said housing in said first direction and an unlatched position in which said housing is free to move in said first direction;

a second latch unit mounted for pivotal movement between a latched position in which said second latch unit engages and prevents movement of said housing in said opposite direction, and an unlatched position in which said housing is free to move in said opposite direction;

biasing means biasing said first and second latch units to said latched positions;

trip means carried by said rod for moving said first and second latch units from said latched positions to said unlatched positions at predetermined points of travel of said rod;

said rod being movable in said first direction with said first latch unit in said latched position preventing movement of said housing in the first direction to load said one spring until said trip means moves said first latch unit to said unlatched position releasing said housing which in turn is accelerated in said first direction by said one spring, and said rod being movable in the opposite direction with said second latch unit in said latched position preventing movement of said housing in said opposite direction to load said other spring until said trip means moves said second latch unit to said unlatched position releasing said housing which in turn is accelerated by said other compression spring in said opposite direction;

said first and second latch units each comprising a pair of latch members with the members of said pair pivotally mounted on opposite sides of said housing, said latch members each having a latch bar which, with said latch members rotated toward each other to the latched position, engages an end of said housing to prevent movement of said housing in the direction of that end of the housing; and said housing defining a longitudinal slot, wherein said trip means comprises a radial projection extending radially outward from said rod through said slot, and wherein said latch members have camming surfaces, said radial projection engaging said camming surfaces as said rod moves in a direction toward the end of said housing engaged by the latch members and pivoting said latch members from the latched position away from each other to the unlatched position in which the latch bars on said latch members are disengaged from said housing.

* * * * *